US010342335B1

(12) United States Patent
Fazi

(10) Patent No.: US 10,342,335 B1
(45) Date of Patent: Jul. 9, 2019

(54) SHELF LOCK ASSEMBLY

(71) Applicant: Dometic Sweden AB, Solna (SE)

(72) Inventor: Mark Raymond Fazi, Osceola, IN (US)

(73) Assignee: Dometic Sweden AB, Solna (SE)

( * ) Notice: Subject to any disclaimer, the term of this patent is extended or adjusted under 35 U.S.C. 154(b) by 0 days.

(21) Appl. No.: 15/804,384

(22) Filed: Nov. 6, 2017

Related U.S. Application Data

(60) Provisional application No. 62/418,332, filed on Nov. 7, 2016.

(51) Int. Cl.

| | |
|---|---|
| ***A47B 57/00*** | (2006.01) |
| ***A47B 57/40*** | (2006.01) |
| ***F24C 15/16*** | (2006.01) |
| ***F25D 25/02*** | (2006.01) |
| ***A47B 57/32*** | (2006.01) |

(52) U.S. Cl.
CPC ..... *A47B 57/404* (2013.01); *A47B 57/32* (2013.01); *F24C 15/16* (2013.01); *F25D 25/02* (2013.01)

(58) Field of Classification Search
CPC ... A47B 47/022; A47B 96/027; A47B 96/061; A47B 57/42
USPC ..... 312/408
See application file for complete search history.

(56) References Cited

U.S. PATENT DOCUMENTS

| | | | | | |
|---|---|---|---|---|---|
| 857,543 | A * | 6/1907 | Thomas | A47B 57/42 | 211/134 |
| 3,966,158 | A * | 6/1976 | Boundy | A47B 57/42 | 248/243 |
| 4,133,433 | A * | 1/1979 | Wolf | A47B 57/40 | 211/192 |
| 4,154,419 | A * | 5/1979 | Breidenbach | A47B 57/402 | 108/110 |
| 4,324,379 | A * | 4/1982 | Ovitz, III | A47B 57/42 | 248/220.41 |
| 4,684,094 | A * | 8/1987 | Everett | A47B 57/404 | 211/187 |
| 5,022,621 | A * | 6/1991 | Quest | A47B 57/408 | 248/222.13 |
| 5,641,217 | A * | 6/1997 | Caruso | F25D 25/025 | 312/334.23 |
| 6,053,544 | A | 4/2000 | Alvring et al. | | |
| D440,238 | S | 4/2001 | Alvring et al. | | |
| 6,296,285 | B1 | 10/2001 | Alvring et al. | | |
| 6,357,803 | B1 | 3/2002 | Lorek | | |
| 8,104,800 | B2 | 1/2012 | Lorek | | |
| 2004/0104581 | A1 | 6/2004 | Lorek et al. | | |

(Continued)

OTHER PUBLICATIONS

US Patent and Trademark Office, U.S. Appl. No. 15/804,414 entitled "Applicance Lock Assembly" filed Nov. 6, 2017.

*Primary Examiner* — Matthew W Ing
(74) *Attorney, Agent, or Firm* — Middleton Reutlinger

(57) ABSTRACT

Present embodiments relate to a shelf system for an appliance which has a lock device that may be easily retrofitted to render the shelves locked in position rather than removable and/or adjustable. The lock system inhibits rotation of the shelf in a direction normally required for removal of the shelf and movement thereof. The lock may be formed integrally or may be formed separately of the shelf support or bracket and may be connected to the bracket once the shelf is in a desired position in order to lock the shelf in place.

10 Claims, 13 Drawing Sheets

(56) References Cited

U.S. PATENT DOCUMENTS

| | | | |
|---|---|---|---|
| 2008/0083242 | A1 | 4/2008 | Muller et al. |
| 2017/0362864 | A1 | 12/2017 | Fazi |

* cited by examiner

SHELF LOCK ASSEMBLY

CLAIM TO PRIORITY

This non-provisional patent application claims priority to and benefit of, under 35 U.S.C. § 119(e), U.S. Provisional Patent Application Ser. No. 62/418,332, filed Nov. 7, 2016 and titled "Shelf Lock Assembly", all of which is incorporated by reference herein.

BACKGROUND

Field of the Invention

The present embodiments relate to a shelf lock assembly for an appliance. More specifically, present embodiments relate to a shelf lock assembly for an appliance so that the appliance may be retrofitted or designed for use in a mobile operations environment, such as a truck, recreational vehicle ("RV"), boat or other moveable structure.

Description of the Related Art

When installing a mobile appliance such as a refrigerator, oven, shelves, or any such appliance, some regulations require that the appliance be locked in a closed position to inhibit doors, drawers or other closure from opening and the contents of the appliance falling out during mobile operations. It is desirable therefore to provide such locking features on mobile appliances.

Regulations may also require the ability to lock shelves, so they may not be removed without deliberate effort to disengage a locking feature. This is desirable so that the shelves do not detach from the appliance interior and fall within or out of the appliance.

More frequent in mobile applications are home appliances which are generally larger and may have a more desirable aesthetic appearance. However, such home or stationary-type appliances generally do not utilize locking features on any of the doors or shelves of such appliance types.

It would be desirable to utilize residential model appliances with mobile operations or settings and provide locking features for appliance shelves and/or drawers.

It would further be desirable to require minimal effort for installation of any such locking features in combination with existing hardware on residential-type appliances.

It would further be desirable to limit the modifications necessary to an existing appliance in adding the lock to render the appliance usable for mobile operations.

The information included in this Background section of the specification, including any references cited herein and any description or discussion thereof, is included for technical reference purposes only and is not to be regarded subject matter by which the scope of the invention is to be bound.

SUMMARY

The present application discloses one or more features recited in the appended claims and/or the following features which, alone or in any combination, may comprise patentable subject matter.

Present embodiments relate to a shelf system for an appliance which has a lock device that may be easily retrofitted to render the shelves locked in position rather than removable and/or adjustable. The lock system inhibits rotation of the shelf in a direction normally required for removal of the shelf and movement thereof. The lock may be formed integrally or may be formed separately of the shelf support or bracket and may be connected to the bracket once the shelf is in a desired position in order to lock the shelf in place.

According to some embodiments, a shelf lock assembly comprises an appliance housing having an interior cabinet formed in the housing, a plurality of mounting apertures in the cabinet for adjustably positioning of at least one shelf, a shelf bracket which supports said at least one shelf, the shelf bracket having at least one bracket retainer which extends through and is engaged on a rear side of at least one of the mounting apertures, further comprising a bracket lock which extends from the shelf through at least one of the plurality of mounting apertures, the bracket lock inhibiting rotational movement of the shelf bracket to disengage the at least one bracket retainer from the mounting apertures.

According to some optional embodiments, the bracket lock may be formed separately of the shelf bracket. The bracket lock may be connected to the shelf bracket. The bracket lock may be fastened to the shelf bracket. The bracket lock may have a bracket lock retainer which extends in a direction opposite the at least one bracket retainer of the shelf bracket. The mounting apertures may be formed in at least one mounting rail. The mounting apertures may be formed integrally in the cabinet. The bracket lock may have a body and a bracket lock retainer extending from the body. The bracket lock may have a head and at least one leg depending from the head. The bracket lock may have at least one clamp which engages the shelf bracket and a spring which extends through and expands within the at least one of the mounting apertures. The shelf lock assembly may further comprise a u-shaped bracket lock which extends over the shelf bracket at an engagement point with the at least one mounting aperture.

According to some embodiments, a shelf lock assembly may comprise an appliance housing having a cabinet therein, a plurality of mounting apertures in the cabinet, a shelf bracket having a shelf bracket retainer configured to extend through at least one of the mounting apertures, the shelf bracket configured to rotate and disengage said shelf bracket from said plurality of said mounting apertures, a bracket lock which engages the shelf bracket and inhibits the rotate and disengage of the shelf bracket from the mounting apertures.

According to some optional embodiments, the bracket lock may be located at one of a forward end or a rearward end of the bracket retainer. The shelf lock assembly may further comprise a front mounting rail. The front mounting rail may receive the bracket lock. The bracket lock may engage a forward end of the shelf bracket.

According to some embodiments a method of locking an appliance shelf, comprises the steps of providing an appliance having at least one shelf which is movable between a plurality of positions, providing a plurality of mounting apertures for positional adjustment of the at least one shelf, supporting the at least one shelf with a shelf bracket, engaging the shelf bracket with a bracket lock which inhibits removal of said at least one shelf.

All of the above outlined features are to be understood as exemplary only and many more features and objectives of a shelf lock assembly and may be gleaned from the disclosure herein. Therefore, no limiting interpretation of this summary is to be understood without further reading of the entire specification, claims and drawings, included herewith.

BRIEF DESCRIPTION OF THE DRAWINGS

In order that the embodiments may be better understood, embodiments of the shelf lock assembly will now be described by way of examples. These embodiments are not to limit the scope of the claims as other embodiments of the shelf lock assembly will become apparent to one having ordinary skill in the art upon reading the instant description. Non-limiting examples of the present embodiments are shown in figures wherein:

DETAILED DESCRIPTION

Figure 1:
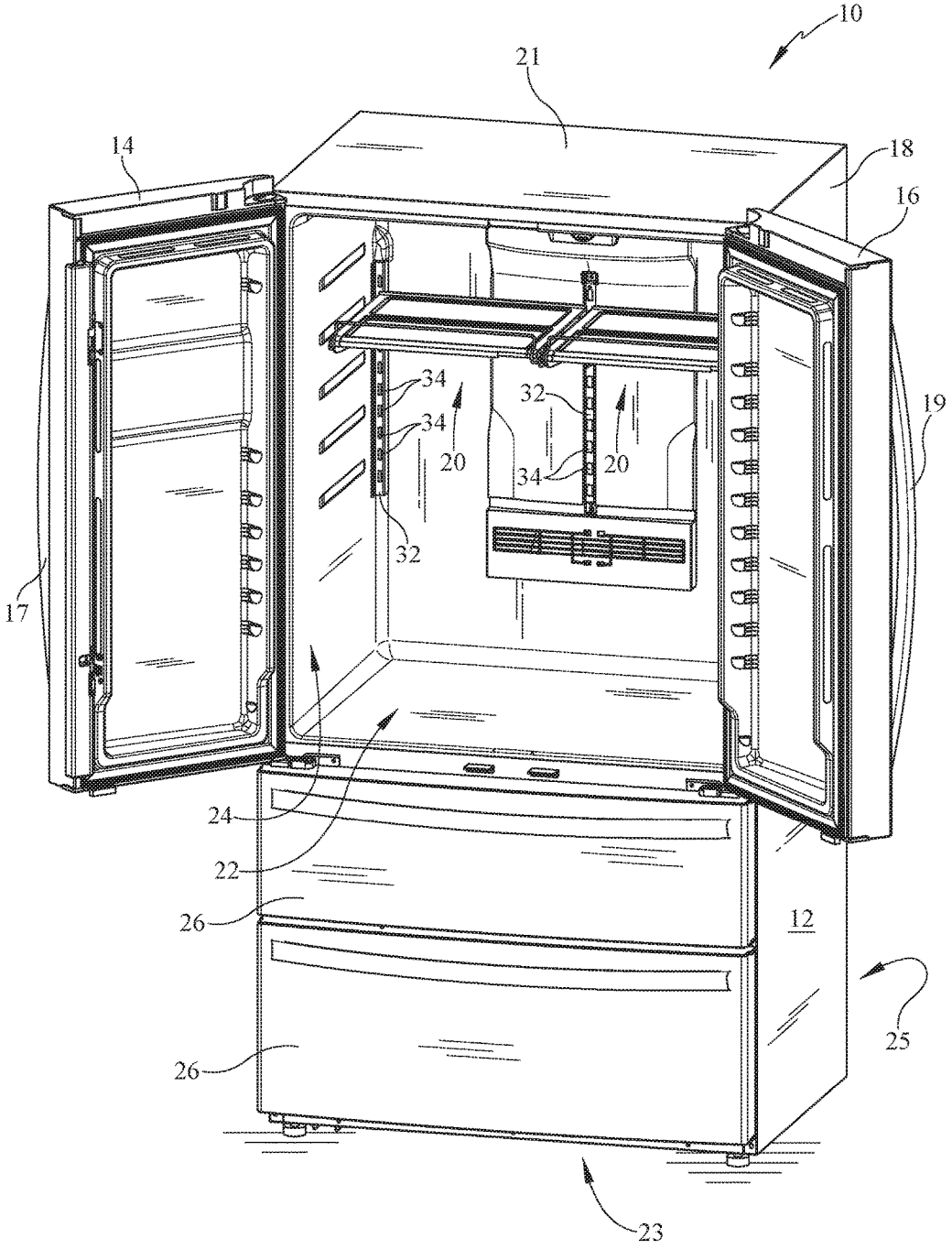
FIG. 1 is a perspective view of an appliance, for example a refrigerator, with an interior revealed.

It is to be understood that the shelf lock assembly is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now in detail to the drawings, wherein like numerals indicate like elements throughout several views, there are shown in FIGS. 1-12B various embodiments related to a shelf lock assembly for an appliance are depicted. The shelf lock assembly provides for a locking feature to retain otherwise moveable shelves within an appliance and inhibits movement and removal of the shelves from the mounting structures to which the shelves are connected. The shelf lock assembly may be a combination of a shelf assembly and a lock which retains a shelf in position.

Referring now to FIG. 1, a perspective view of an appliance 10 is depicted with doors open to further show a shelf assembly 20. The appliance 10 is shown throughout as a refrigerator. However, one skilled in the art should recognize that multiple appliances may be utilized which have either a door or drawer such as ovens, cabinet doors, dishwashers or the like. It is advantageous to provide an assembly which may be added to an appliance and require minimal effort to make a conversion for suitable use in mobile application. For example, it may be desirable to provide an assembly which does not need any further drilling or cutting of the existing appliance and may be utilized merely by inserting and fastening or otherwise the addition of adhesive, epoxy or the like.

The appliance 10 is, according to some embodiments, depicted as a refrigerator and will be referred to throughout this specification. However, one skilled in the art will also recognize that other types of refrigerators may also be utilized. The present embodiment includes a housing 12 having at least one door 14 and in the instant embodiment, a second door 16. The first door and the second door 14, 16 are pivotally connected to the housing 12 to allow access or alternatively, close access to an opening 22. The opening 22 and the refrigerator embodiment provides for access to a cabinet 24 wherein fresh or frozen food may be stored.

The housing 12 may be defined by a plurality of sides 18, a top 21, a bottom 23, and a rear surface 25. On the rear surface 25, or behind the rear surface 25, may be numerous components defining a cooling system, for example compression refrigeration, absorption refrigeration, or thermoelectric, to name a few.

Beneath the first and second doors 14, 16 may be at least one drawer 26. The drawers 26 are an optional feature and may be used in addition to the at least one door 14 of the appliance 10. In alternative embodiments, the at least one drawer 26 may be above or below the at least one door 14. Further, the appliance 10 may have at least one drawer rather than at least one door.

The at least one door 14 may also include a handle 17. In the instant embodiment the at least one door 14 comprises a first handle 17 and a second handle 19. The first and second handles 17, 19 extend in a vertical direction, however other configuration may be used.

Figure 2:
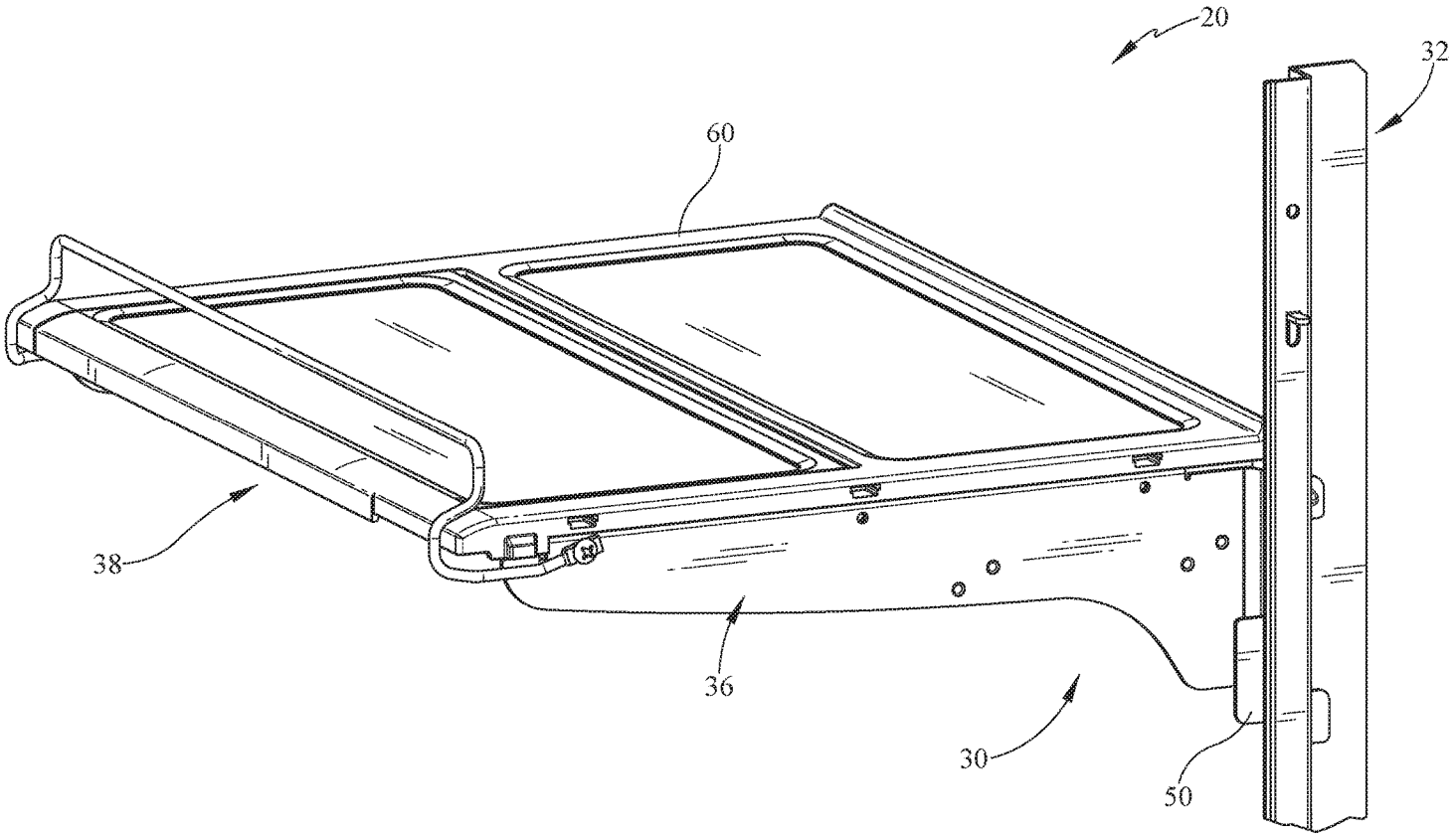
FIG. 2 is an assembled perspective view of a portion of a shelf.

Referring now to FIG. 2, a perspective view of a portion of a shelf assembly 20 is depicted including a bracket lock 50, the combination of which defines a shelf lock assembly 30. The shelf assembly 20 is depicted having a mounting rail 32. The mounting rail 32 may include a plurality of mounting apertures or holes 34, which are more clearly seen in FIG. 4. The shelf assembly 20 further comprises at least one shelf bracket 36. The shelf bracket 36 supports a shelf 38 and the shelf bracket 36 is connected to the plurality of mounting apertures 34 of the mounting rail 32. The assembly 20 may also comprise a shelf frame 60 connecting the shelf 38 and shelf bracket 36.

The shelf lock assembly 30 comprises a bracket lock 50 and the shelf assembly 20. The bracket lock 50 is either formed on the shelf bracket 36 or is formed separately and may be connected to the shelf bracket 36. Whereas residential appliances generally do not move upon installation and there is no need for a lock for the shelves, the addition of the lock allows for additional mobile application. In some embodiments, the bracket lock 50 may also be formed separately and connected to the mounting apertures 34 in order to inhibit movement of the shelf bracket 36 or alternatively, engage the shelf bracket 36 in such a way that the removal of the shelf and/or shelf bracket 36 is inhibited.

Figure 3:
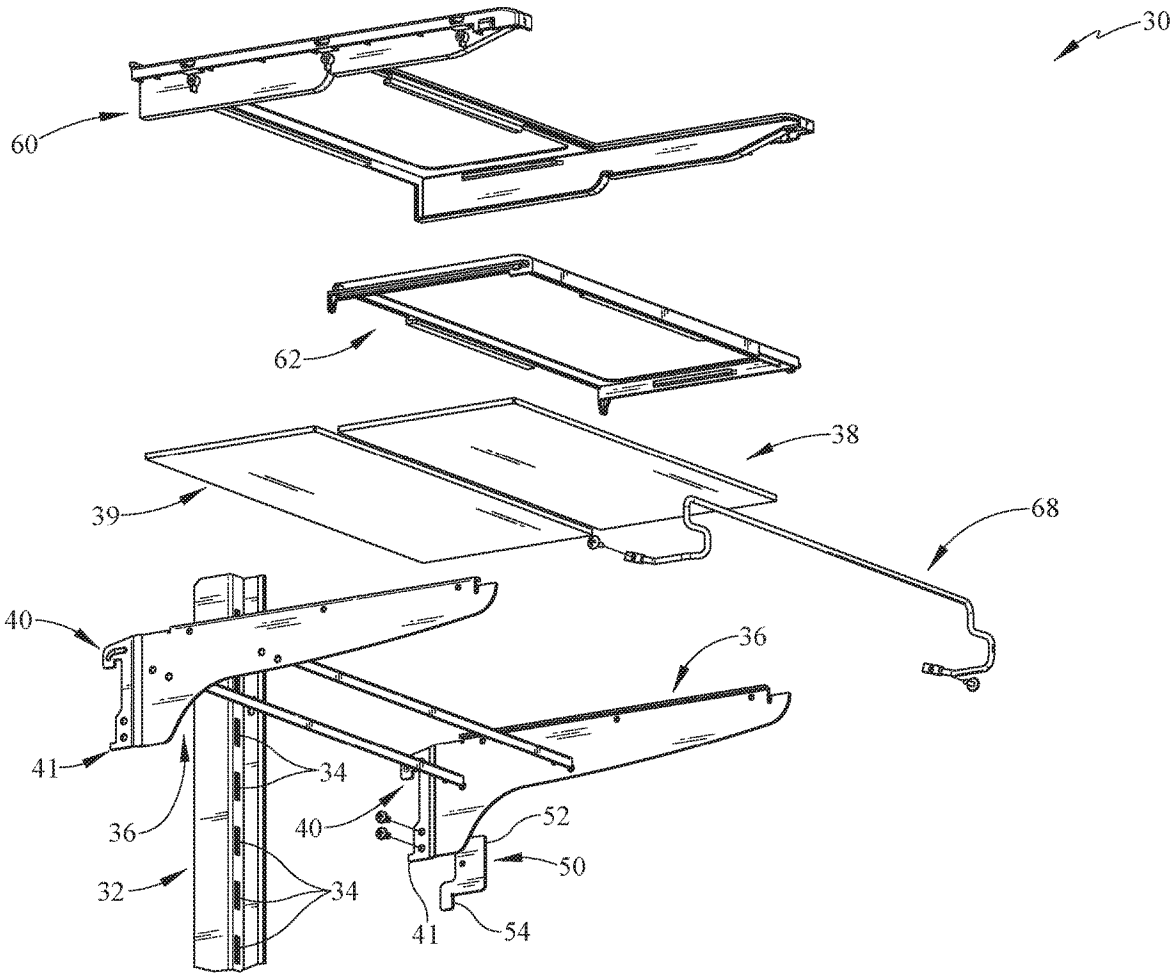
FIG. 3 is an exploded view of a shelf assembly and shelf lock.

Referring now to FIG. 3, an exploded perspective view of the shelf lock assembly 30 is depicted. The mounting rail 32 is depicted having the plurality of mounting apertures 34.

The mounting apertures 34 may be elongated to allow for some pivoting motion of the shelf brackets 36 in order to remove the shelf brackets 36 and shelf 38 when the bracket lock 50 is not utilized.

The mounting rail 32 may be formed, in some embodiments, as an independent structure which is connectable to a cabinet 24 (FIG. 1) or interior of the appliance 10 (FIG. 1). However, in other embodiments, the rail 32 may be formed integrally with the cabinet 24 or alternatively, the mounting apertures 34 may be formed directly in the walls defining the cabinet 24 so that an additional structure is not necessary. The shelf brackets 36 have at least one bracket retainer 40 and additional bracket retainers 41 near upper and lower rear ends of the shelf bracket 36, respectively. Each shelf bracket 36 has a bracket retainer 40, for example upper retainer, which has a substantially L-shaped structure that passes through the mounting apertures 34 and catches the rear surface of the mounting rail 32. In other embodiments, the bracket retainer 40 may catch on a rear surface of a cabinet 24 after passing through the mounting apertures 34.

The shelf brackets 36 have a cantilevered connection to the rail 32 or cabinet 24. The shelf brackets 36 have an upper bracket retainer 40 which is shaped to allow rotation of the opposite end of the shelf brackets 36 upward to remove the lower bracket retainers 41 from the mounting apertures 34. Once this occurs, the shelf brackets 36 may be lifted within the mounting apertures 34 until the lower most edge of the retainers 40 clears the lowermost edge of the mounting apertures 34. When this occurs, the shelf brackets 36 may be pulled forward to remove the shelf 38 from the mounting apertures 34 and then the position on the shelf brackets 36 may be adjusted to raise or lower the shelf 38 and shelf brackets 36.

Positioned above the shelf brackets 36 is at least one shelf 38. The at least one shelf 38 may be two shelves, comprising a first shelf 38 and a second shelf 39. The shelves 38, 39 may be pivotally connected or slidably connected, for example. The shelves 38, 39 may be formed of various materials including plastic or glass or some transparent material depending upon the type of shelf desired. Alternatively, wire shelves may be utilized with the shelf brackets 36.

In the instant embodiment and shown above the shelves 38, 39 are shelf frames 60, 62. The shelf frames 60, 62 may be connected to the shelf brackets 36 and may retain the shelves 38, 39 relative to the shelf brackets 36 and generally as a single structure. In addition to retention and support, the shelf frames 60, 62 may also provide for various slidable, hingeable, or other movements of the shelves 38, 39 relative to one another so that the structure may be adjustable to allow for taller items which may be stored in the appliance 10 (FIG. 1) below the shelf 38, for example.

The shelf brackets 36 and/or the shelf frames 60, 62 may also include a bar 68 extending across a forward end of the shelf lock assembly 30. The bar 68 is desirable to provide a stop in case materials which are moving on the at least one shelf 38 slide forward. The bar 68 may stop those items from sliding off of the forward end of the at least one shelf 38. The bar 68 may take various forms but generally is connected at one shelf bracket 36 or one side of frames 60, 62 and extends to the opposite shelf bracket 36 or side of shelf frames 60, 62. When installed, the bar 68 should extend above the upper surface of the at least one shelf 38 so that it may engage materials that may slide on the at least one shelf 38.

Referring again to the lower portion of the figure, a bracket lock 50 is also shown. The bracket lock 50 has a body 52 and a lock retainer 54 connected to the body 52. As previously discussed, in order to move the shelf brackets 36 and at least one shelf 38 relative to the mounting rail 32 or at least one of the mounting apertures 34, the shelf brackets 36 must be rotated to remove the bracket retainers 41 from the mounting apertures 34. At that time, the shelf brackets 36 may be raised from the mounting apertures 34 and removed therefrom. The bracket locks 50 connect to the shelf brackets 36 and once connected, the lock retainers 54 preclude the rotation of the forward ends of the shelf brackets 36 so that the shelf brackets 36 are locked in position. By inhibiting the removal movement, the shelf bracket 36 and shelf 38 may not be removed.

The bracket locks 50 may be integrally formed with the shelf brackets 36 or may be connectable by way of various means such as fasteners, epoxies, adhesives or other connecting structures or materials so that once the shelf brackets 36 are positioned in the mounting apertures 34, the bracket lock 50 may be connected to the shelf bracket 36 retaining the structure in position. Further, the bracket lock 50 may merely engage, but not be connected to, the shelf bracket 36 to prevent removal or pivoting of the shelf bracket 36.

Figure 4:
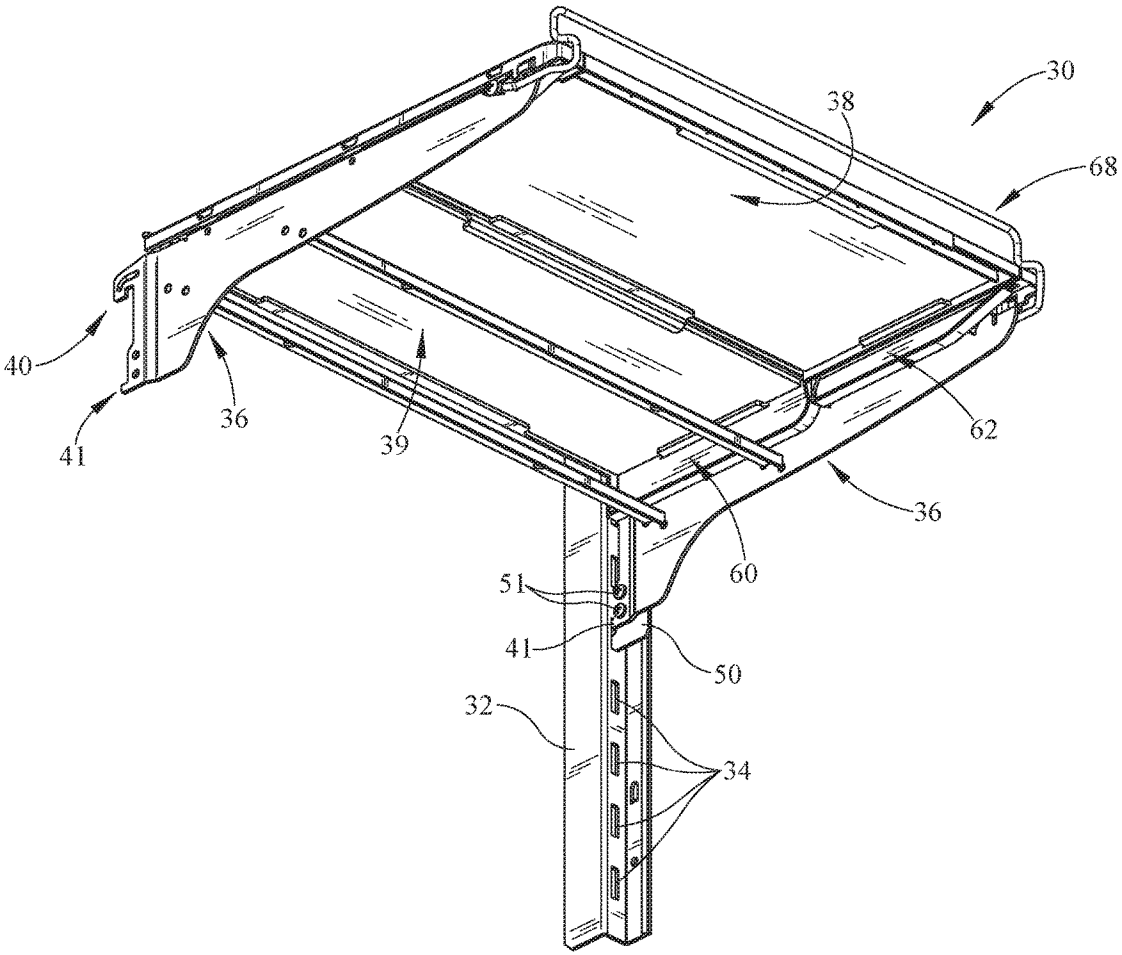
FIG. 4 is a lower perspective view of the embodiment of the shelf assembly and shelf lock.

Referring now to FIG. 4, a lower perspective view of the shelf lock assembly 30 is depicted in an assembled manner. The shelf brackets 36 are depicted positioned in at least one mounting rail 32 having a plurality of mounting apertures 34. In the embodiment depicted, the at least one shelf 38, 39 is positioned in the shelf frames 60, 62 and on the shelf brackets 36.

In this embodiment, the bracket lock 50 is extending through the same apertures as a lower bracket retainer 41. The bracket lock 50 is shown connected to the shelf bracket 36 by at least one fastener 51 and according to the depicted embodiment, two fasteners 51. The lock retainer 54 (FIG. 3) is positioned through the mounting aperture 34 and below a lower edge thereof. The shelf bracket 36 is in a cantilevered configuration from the rail 32. Once the bracket lock 50 is positioned as shown in FIG. 4 and connected to the shelf bracket 36, the forward end of the shelf bracket 36, close to the bar 68, cannot be rotated upwardly to move the shelf bracket 36. In this manner, the bracket locks 50 must be disconnected or otherwise removed from mounting apertures 34 in order to adjust the position of the shelf 38 vertically relative to the rail 32 or relative to the mounting apertures 34. In alternative embodiments, the bracket lock 50 may be installed in a different aperture than the lower bracket retainer 41. For example, the bracket lock 50 could be changed in size and/or shape to install through an aperture below the lower bracket retainer 41.

Figure 5:
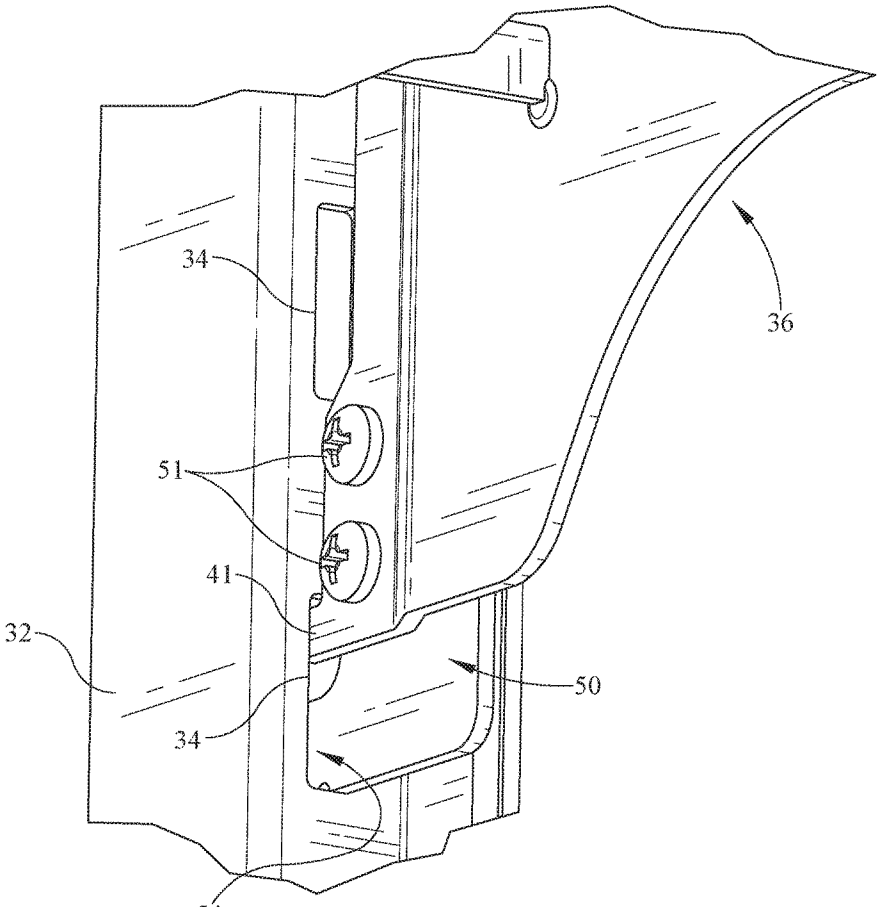
FIG. 5 is a detailed perspective view of a shelf bracket engaging mounting apertures and a shelf lock connected to the shelf bracket.

Referring now to FIG. 5, a detailed perspective view of the shelf bracket 36 is shown at the location where the bracket lock 50 is connected. As depicted in the embodiment, the bracket lock 50 includes the lock retainer 54 which extends through the same mounting aperture 34 as the bracket retainer 41. With the lock retainer 54 extending through, this precludes the movement of the shelf bracket 36 in an upward pivoting motion. Thus, the shelf bracket 36 cannot be moved or otherwise adjusted relative to the mounting apertures 34 and/or the mounting rail 32 with the bracket lock 50 in position.

In the instant embodiment, the bracket lock 50 is generally planar. The structure may be located either side of the shelf bracket 36 or alternatively, may be disposed on both sides of the shelf bracket 36 if the bracket lock 50 is U-shaped.

The bracket lock 50 may take other forms as well. For example, the bracket lock 50 may be a structure which extends into the mounting aperture 34 and wedges therein in order to inhibit rotational removal of the lower shelf bracket retainer 41. Still other structures may be utilized, for example, a bracket lock 50 which extends through the same or different aperture of the plurality of mounting apertures 34 and which may also extend through or otherwise engage or be connected to the shelf bracket 36. For example, with reference still to FIG. 5, a bracket lock 50 may extend through a mounting aperture 34 and a hole may be formed in the shelf bracket 36 so that such bracket lock 50 extends through the aperture 34 of the shelf bracket 36 and cannot be removed from the mounting aperture 34. Such structure may reduce the need for fasteners, adhesives or other connecting structures or materials between the two parts.

Figure 6:
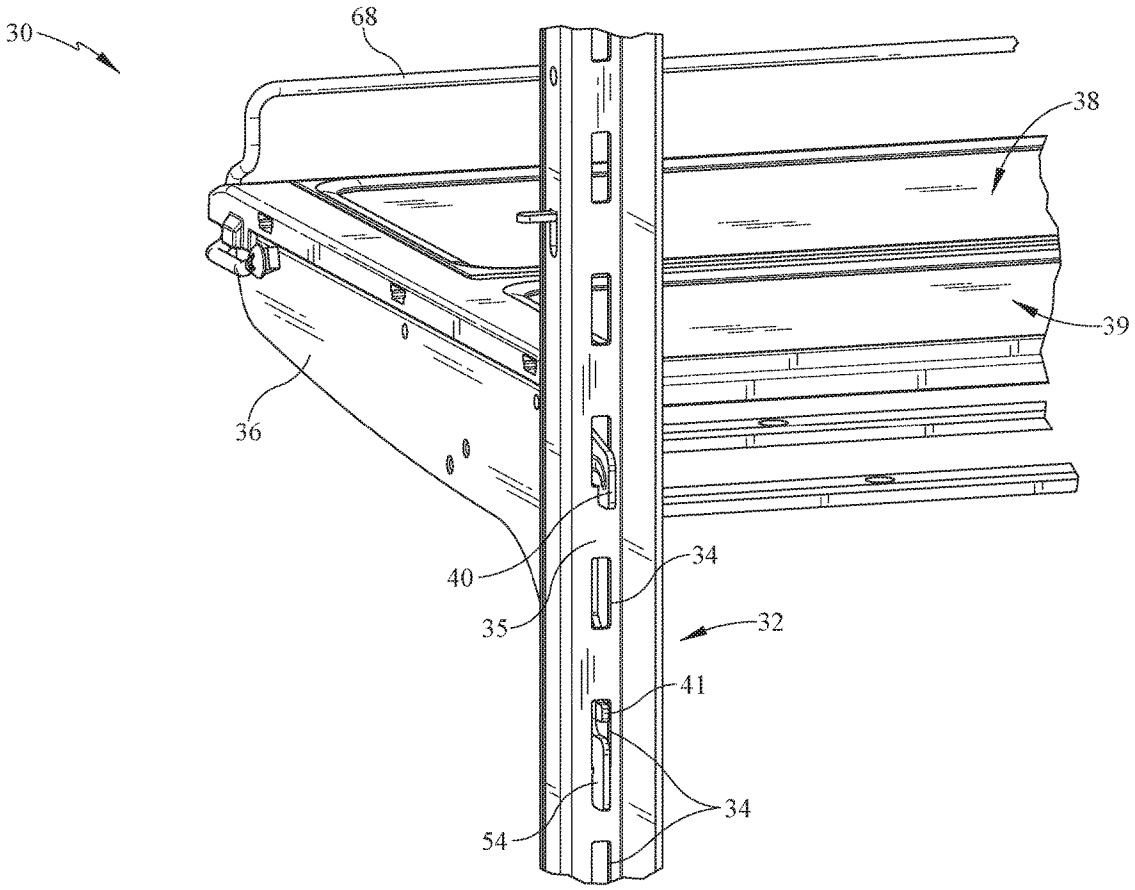
FIG. 6 is a rear perspective view of the shelf assembly and shelf lock.

Referring now to FIG. 6, a rear view of the shelf lock assembly 30 is depicted in perspective view. The at least one shelf 38 is supported by the shelf bracket 36 and plurality of mounting apertures 34 to which the shelf bracket 36 is connected. In this rear view, the bracket retainer 40 is shown extending below a lower edge of a mounting aperture 34. In this manner of connection, a downward force caused by gravity causes the bracket retainer 40 to engage the rear surface 35 in which the mounting apertures 34 are formed. Thus, the shelf brackets 36 and at least one shelf 38 are held in position. Spaced two mounting apertures 34 below the bracket retainer 40 is the lower bracket retainer 41 which is shown through another mounting aperture 34. Within this mounting aperture 34 where the bracket retainer 41 is positioned, the lock retainer 54 is also shown extending through. As previously described, in order to normally move the shelf bracket 36 and the at least one shelf 38 without the bracket lock 50 in position, the shelf bracket 36 is rotated upwardly to remove the bracket retainers 41 from the mounting apertures 34 and subsequently, the bracket retainer 40 may be lifted within the mounting aperture 34 where it is positioned and pulled out from the mounting apertures 34 and the mounting rail 32 if such is utilized to define the mounting apertures 34. Alternatively, with the bracket lock 50 (FIG. 2) in position, the lock retainer 54 extends through the same mounting aperture 34 as the bracket retainer 41 and inhibits the upward rotation of the assembly 30 which is otherwise necessary to remove bracket retainer 41 from the mounting aperture 34. In this way, the shelf bracket 36 and the at least one shelf 38 connected thereto, cannot be removed from the mounting apertures 34.

Figure 7A:
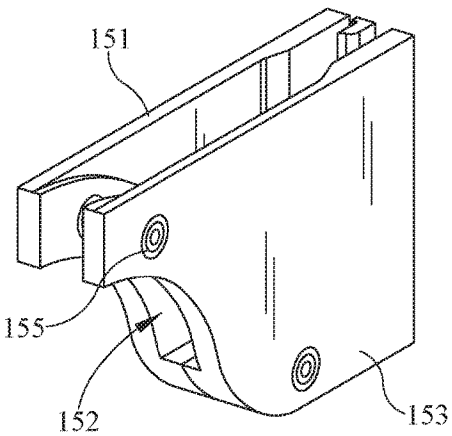
FIG. 7A is a perspective view of an alternative embodiment of a bracket lock.
Figure 7B:
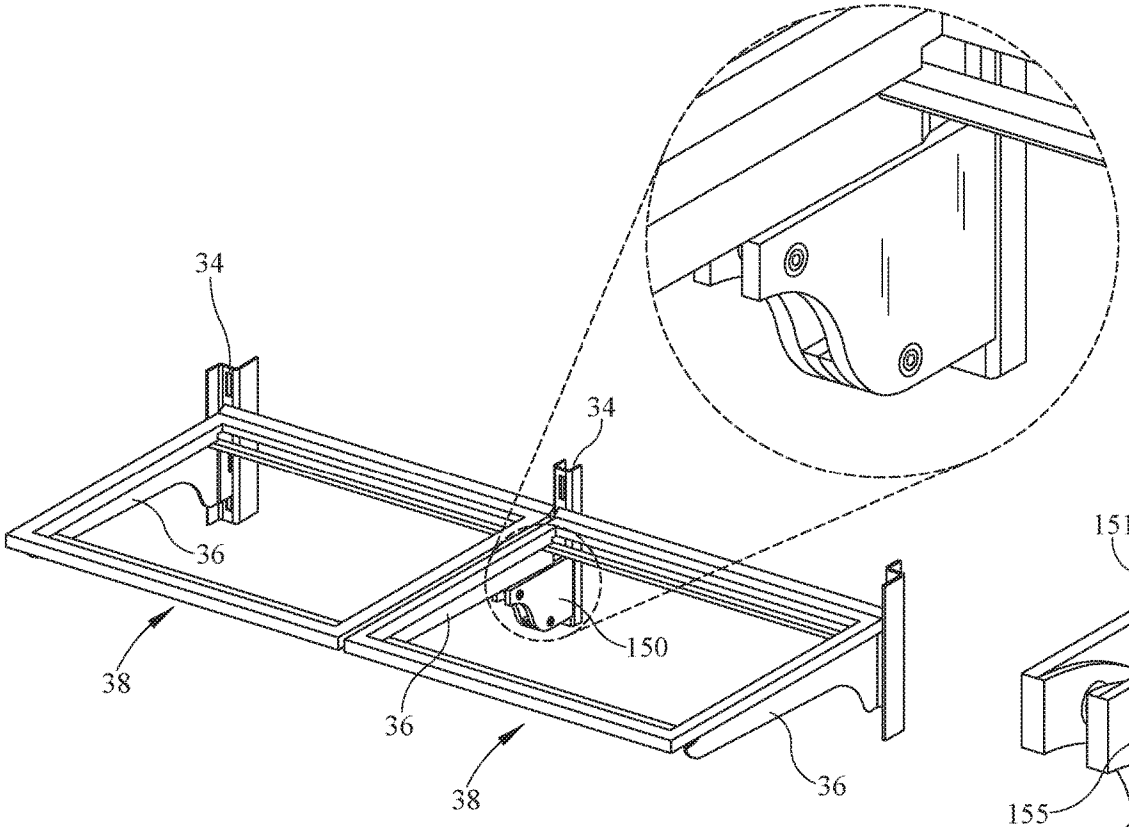
FIG. 7B is a perspective view of the bracket lock disposed in a shelf lock assembly.

Referring to FIGS. 7A and 7B, perspective views of an alternate embodiment of a bracket lock 150 and the perspective assembly is provided. In this embodiment, a bracket lock 150 is provided having a first side 151 and a second side 153. The space 152 between the first and second sides 151, 153 is generally hollow to receive at least one shelf bracket 36. The shelf bracket 36 is partially positioned in the space 152 between the sides 151, 153 and the rear of the bracket lock 150 may comprise at least one retainer which engages the plurality of mounting apertures 34. In this embodiment, two shelves 38 may be placed side by side and the central location where the two shelves 38 are adjacent may include the bracket lock 150 so that shelf brackets 36 of the two shelves 38 are located within the bracket lock 150. In such way, the bracket lock 150 supports the shelves 38. Or, alternatively, the shelf brackets 36 may engage the mounting apertures 34 and the bracket locks 150 may be mounted below, but not in a supporting configuration. The bracket lock 150 may also comprise a catch or other structure towards the rear of the bracket lock 150 to retain the shelf brackets 36. Alternatively, in other embodiments, the bracket retainers 40, 41 (FIG. 6) may extend through the rear of the bracket lock 150 to engage the mounting apertures 34. The bracket lock 150 may be supported on the shelf bracket 36. In this embodiment, where the intent is to inhibit the ability of the shelf 38 or shelf bracket 36 from being rotated so that they can be removed from the mounting apertures 34. The bracket lock 150 may include a rotation stop 155 which may be a bolt, fastener or other structure which limits rotation of a shelf 38 and shelf bracket 36. Instead, the bracket lock 150 needs to be removed or otherwise disengaged in order to allow removal of the shelves 38.

Figure 8A:
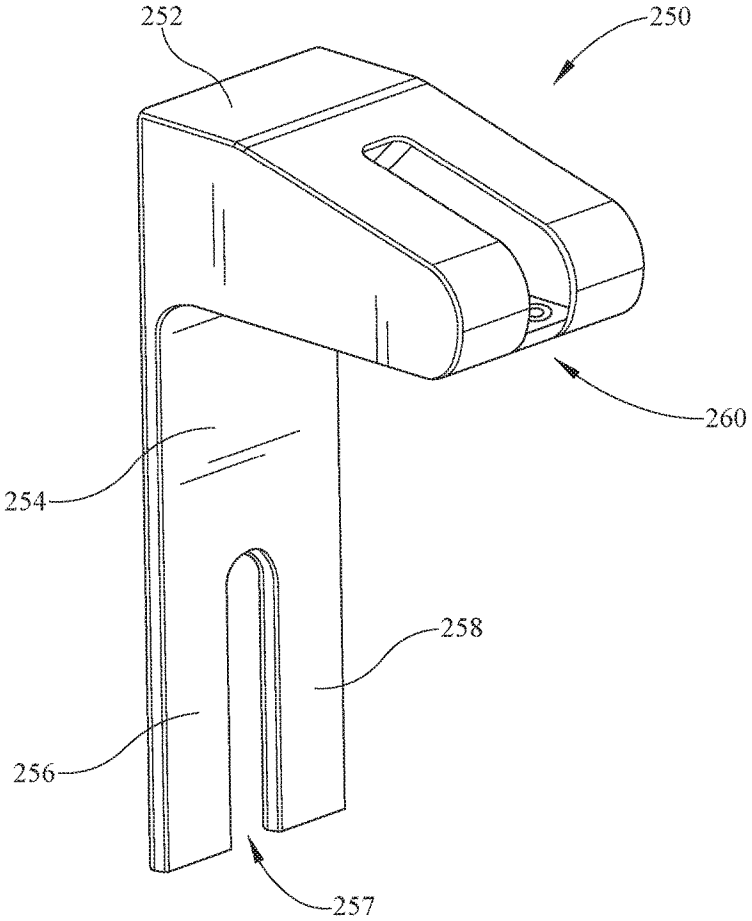
FIGS. 8A and 8B are a series of perspective views of an alternative bracket lock.

Referring now to FIG. 8A, a perspective view of a further alternative bracket lock 250 is depicted. The bracket lock 250 includes a head 252, a body 254, and first and second legs 256, 258. A space 257 is defined between the legs 256, 258 and the legs may straddle a lower portion of shelf bracket 36 (FIG. 7). A gap 260 is formed in the head 252 and an edge of the shelf bracket 36 may be disposed in the head gap 260.

When the bracket lock 250 is positioned between the shelf bracket 36 and the mounting apertures 34 (FIG. 7) in the described arrangement, the shelf bracket 36 cannot be rotated at a front edge and therefore, the shelf bracket 36 and the accompanying shelf 38, cannot be removed.

Figure 8B:
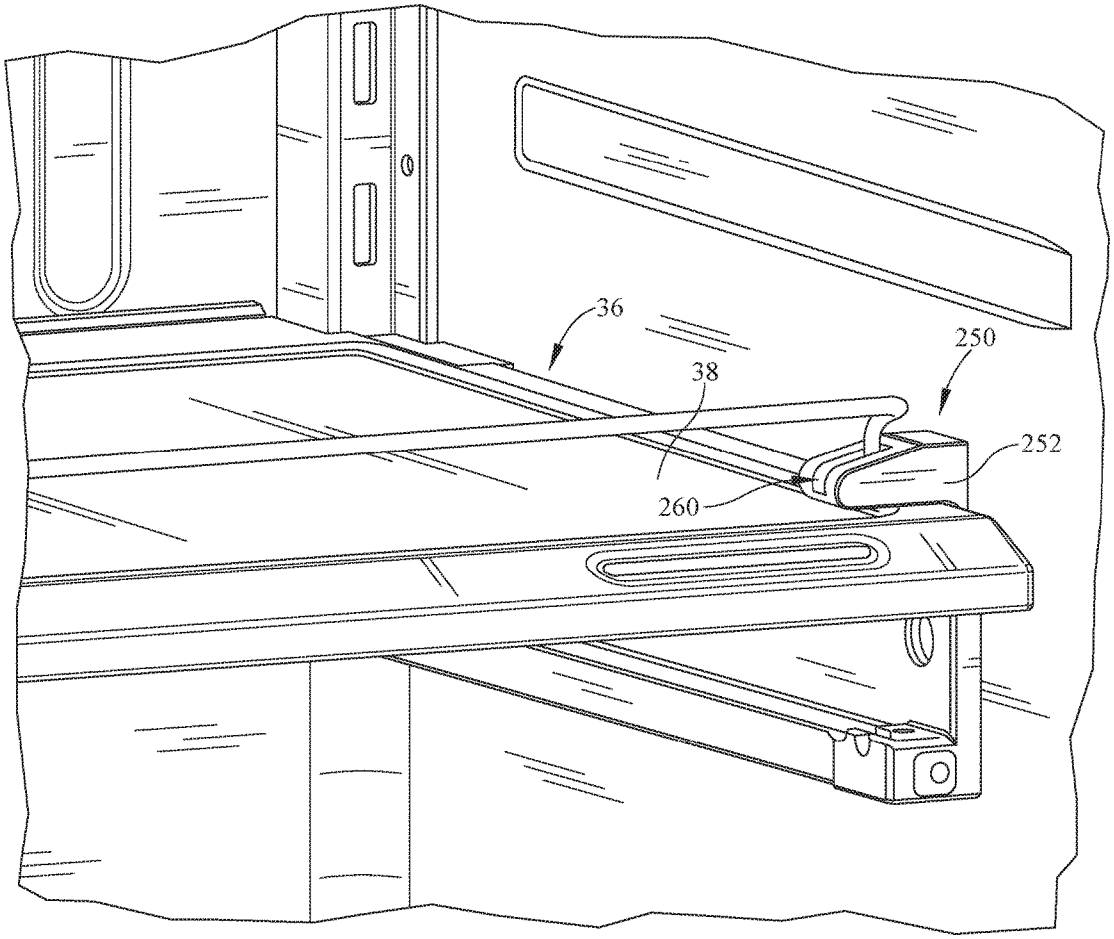

In other embodiments, such as shown in FIG. 8B, the bracket lock 250 may be used to retain a forward end of a shelf bracket in position. In this embodiment, the legs 256, 258 may straddle a fastener which keeps the bracket lock 250 in a desired position. In this embodiment, the lock bracket 250 may extend from an interior sidewall toward the interior of the appliance, so that the head 252 extends perpendicular to a front edge of the shelf bracket 36. Next, the shelf 38, bracket 36 or other portion of the assembly may be seated in the head gap 260 and retained therein inhibiting rotation of the shelf bracket 36. In the instant example, the gap 260 receives bars 68 to retain them in position.

Figure 9A:
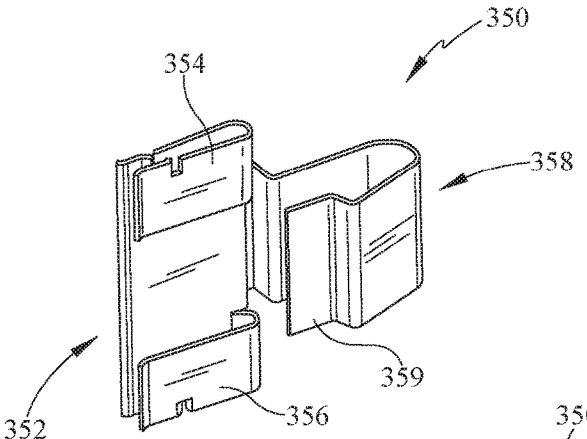
FIGS. 9A-9C are a series of perspective views of a further alternate bracket lock in two positions and an assembly.
Figure 9B:
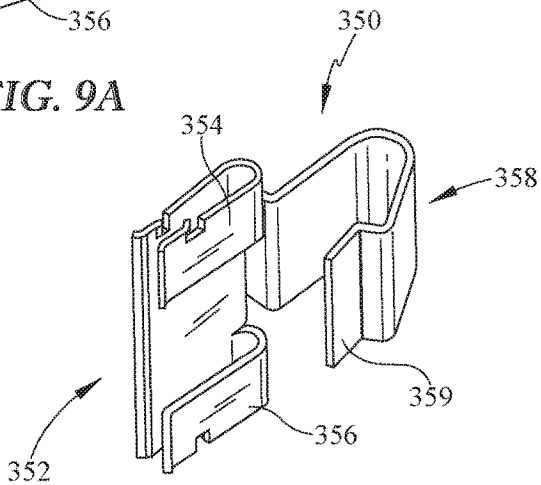
Figure 9C:
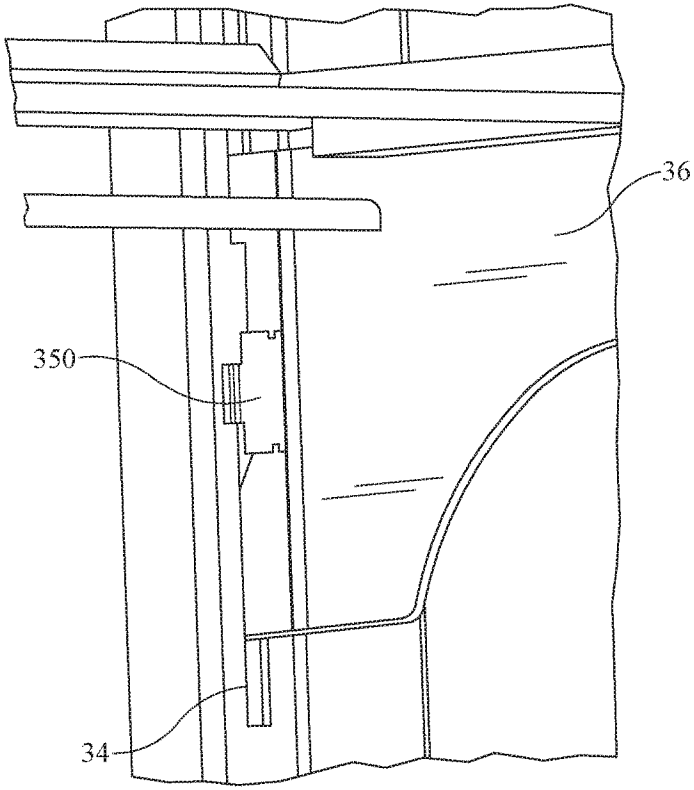

Referring now to FIGS. 9A through 9C, a further embodiment is provided of a bracket lock 350 and a perspective detail assembly view. The bracket lock 350 is shown in two positions in FIGS. 9A and 9B. In FIG. 9A, the bracket lock 350 is shown in a closed position which is the position when the bracket lock 350 is extending through a mounting aperture 34 and in FIG. 9B, the bracket lock 350 is shown in an open position when the bracket lock 350 is removed from a mounting aperture 34. The bracket lock 350 includes a clamp 352 with at least one arm 354, 356 and in the depicted embodiment, two arms. The bracket lock 350 also comprises a spring 358 which may be positioned through the aperture 34. The spring 358 also comprises a tab 359 to engage or disengage the spring 358 and bracket lock 350. The clamp 352 engages a rear edge of the shelf bracket 36 so that once the shelf bracket 36 is extending from the clamp 352 and the spring 358 extends through the mounting aperture 34, the shelf bracket 36 may not be pivoted or rotated in order to remove from the mounting apertures 34 of the appliance 10 (FIG. 1). Thus, the structure is locked in position until the bracket lock 350 is removed. FIG. 9C shows a perspective rear view of the shelf bracket 36 and the engagement of the embodiment of the bracket lock 350.

Figure 10B:
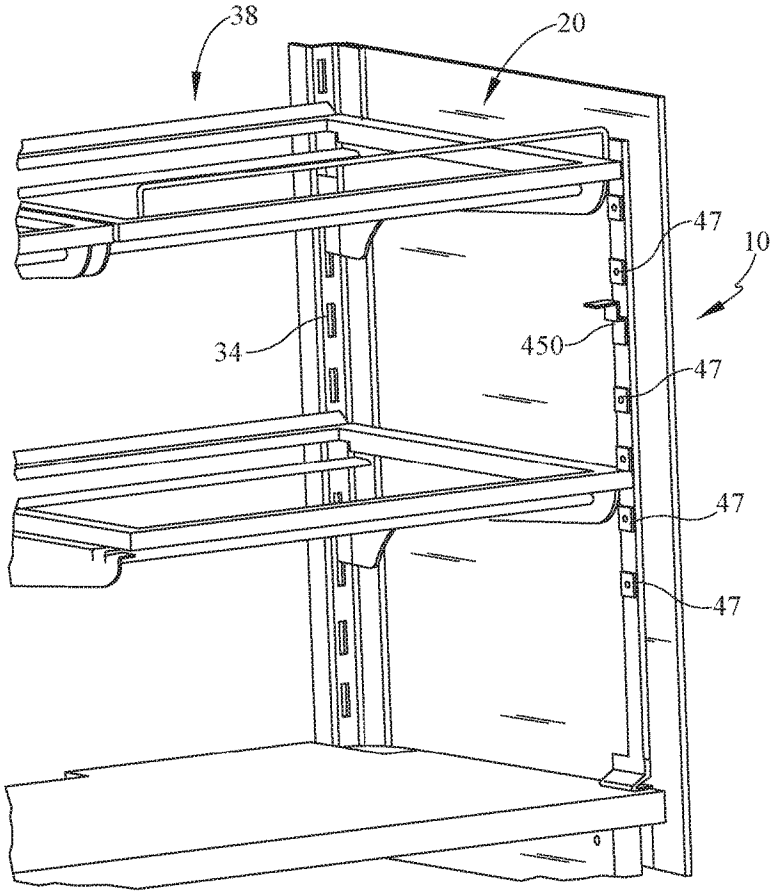
FIGS. 10A and 10B are a series of views of a still further embodiment and related assembly.
Figure 10A:
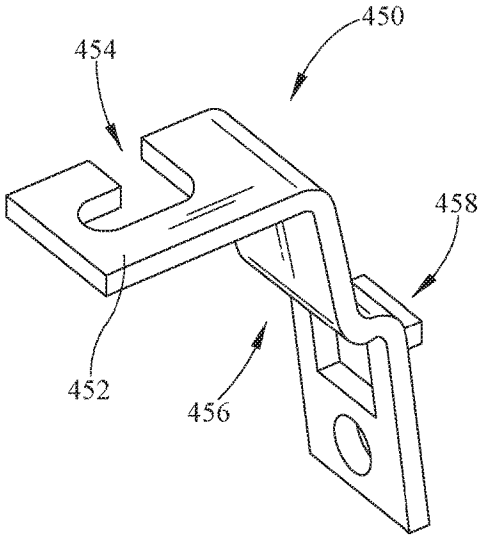

Referring now to FIGS. 10A and 10B, perspective views are shown of a further bracket lock 450 and an assembly perspective view of the bracket lock 450 mounted in an appliance 10. The bracket lock 450 differs in part because the locking and support function occurs at the forward end of the shelf assembly 20.

The bracket lock 450 includes a head 452 with a notch 454 which receives a portion of a shelf 38 or the assembly 20 in general. The head 452 defines a support upon the shelf 38 and is positioned to inhibit rotation and removal of the shelves 38. Depending from the head 452 is a leg 456, having a foot 458 which may engage a mounting aperture 47 in the appliance 10 and toward a forward end of the shelf 38. The mounting apertures 47 may be located at various vertical locations so that the height of the shelf 38 may be adjusted as with the rear mounting apertures 34 (FIG. 10 B) as previously described.

With the foot 458 engaging an aperture 47 more specifically, the foot 458 is arranged perpendicular to, or at some angle to the upward or downward movement of the shelf 38, in order to remove such shelf 38. The shelf bracket 36 or assembly 20 may not be rotated to disengage the rear mounting apertures 34.

Figure 11B:
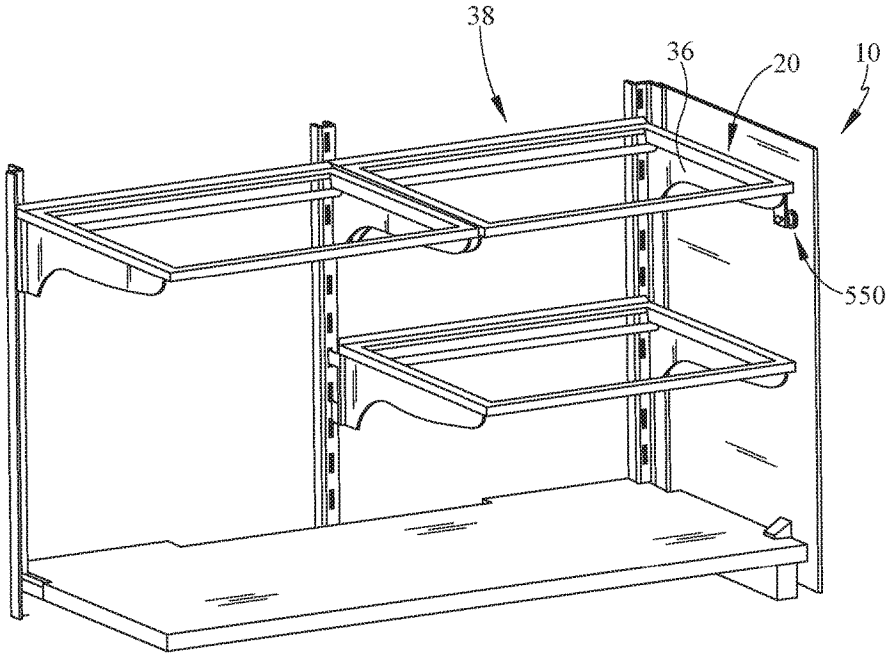
FIGS. 11A and 11B are a series of perspective views of a further embodiment of a bracket lock; and, FIGS. 12A and 12B are a series of perspective views of an alternate embodiment.
Figure 11A:
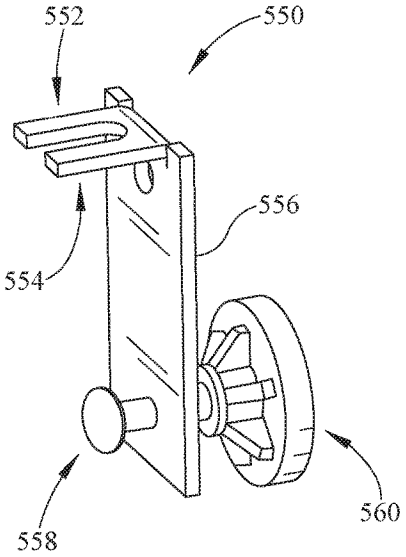

Referring now to FIGS. 11A and 11B, a further embodiment of a bracket lock 550 is depicted and including an assembly perspective view. The embodiment of the bracket lock 550 is similar to the previous embodiment of FIG. 10A in that the bracket lock 550 is located at a forward end of the shelf 38 rather than the rear of the shelf 38. The bracket lock 550 includes first and second arms 552, 554 which support a forward end of the shelf 38 and specifically, the shelf bracket 36. One of the shelf 38 and/or bracket shelf 36 may have a catch which extends between the arms 552, 554. Depending from the arms 552, 554 is a body 556 having a fastener or other retainer 558 which is connected to a mounting pad 560 on an opposite side of the arms 552, 554. As the fastener 558 is tightened the mounting pad 560 is forced against the cabinet or other interior surface within the appliance 10. This force of the mounting pad pushing back on the body 556 inhibits or precludes rotation of the shelf 38 upward or downward at the forward end. Alternatively, a nut or similar fastener may be disposed in the appliance 10 to receive fastener 558 to provide the locking function and eliminate the mounting pad 560.

Figure 12B:
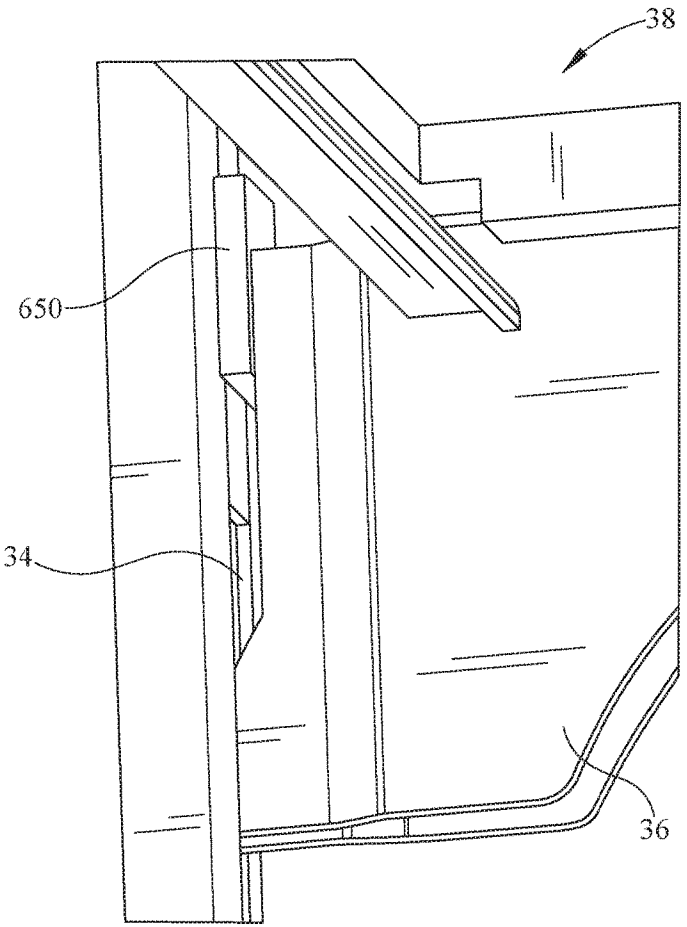
Figure 12A:
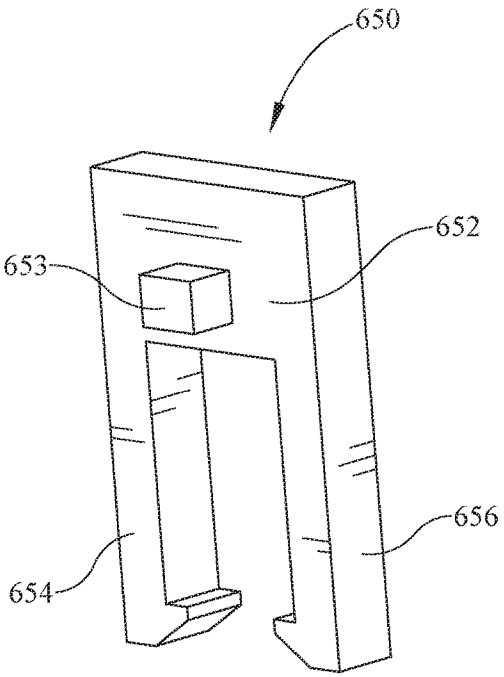

Referring now to FIGS. 12A and 12B, a further alternative embodiment is depicted. The embodiment provides a bracket lock 650 which is disposed at a rear end of the shelf 38 and more specifically, at the rear end of the shelf bracket 36. The bracket lock 650 includes a head 652 with depending legs 654, 656. The bracket lock 650 further comprises an arm 653 which extends from near the head 652 and engages a mounting aperture 34 where the shelf bracket 36 is positioned. The bracket lock 650 is positioned between the rear edge of the shelf bracket 36 and the mounting apertures 45 and inhibits rotation of the shelf bracket 36 which is necessary to remove the shelf 38 from the mounting apertures 45. The legs 654, 656 depend downwardly over the side edges of the shelf bracket 36.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teaching(s) is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

What is claimed is:

1. A shelf lock assembly, comprising:

an appliance housing having an interior cabinet formed in said housing;

a plurality of mounting apertures in said cabinet for adjustably positioning of at least one shelf;

a shelf bracket which supports said at least one shelf, said shelf bracket having at least one bracket retainer which extends through and is engaged on a rear side of at least one of said mounting apertures;

a lower bracket retainer extending from said shelf bracket and spaced below said at least one bracket retainer;

further comprising a removable bracket lock which extends from said shelf bracket through at least one of said plurality of mounting apertures, said removable bracket lock being fixed relative to said shelf bracket when engaging said shelf bracket;

said removable bracket lock having a lock retainer positioned to extend through a same one of said plurality of mounting apertures as said lower bracket retainer and inhibiting rotational movement of said shelf bracket to disengage said at least one bracket retainer from said mounting apertures, wherein said lock retainer extends downward.

2. The shelf lock assembly of claim 1, wherein said bracket lock is formed separately of said shelf bracket.

3. The shelf lock assembly of claim 2, wherein said bracket lock is connected to said shelf bracket.

4. The shelf lock assembly of claim 3, wherein said bracket lock is fastened to said shelf bracket.

5. The shelf lock assembly of claim 1 wherein said mounting apertures are formed in at least one mounting rail.

6. The shelf lock assembly of claim 1, wherein said mounting apertures are formed integrally in said cabinet.

7. The shelf lock assembly of claim 1, said bracket lock having a body and a bracket lock retainer extending from said body.

8. A shelf lock assembly, comprising:

an appliance housing having a cabinet therein;

a plurality of mounting apertures in said cabinet;

a shelf bracket having an upper shelf bracket retainer configured to extend through at least one of said mounting apertures, said shelf bracket configured to rotate and disengage said shelf bracket from said plurality of said mounting apertures;

a lower shelf bracket retainer spaced from said upper shelf bracket retainer;

a removable bracket lock which engages said shelf bracket and has a lock retainer which extends downward, said removable bracket lock being fixed relative to said shelf bracket when engaged, and said lock retainer being positioned to pass through a same one of said plurality of mounting apertures as said lower shelf bracket retainer, wherein said removable bracket lock inhibits said rotate and disengage of said shelf bracket from said mounting apertures.

9. The shelf lock of claim 8, said bracket lock being located at one of a forward end or a rearward end of said bracket retainer.

10. A method of locking an appliance shelf, comprising:

providing an appliance having at least one shelf which is movable between a plurality of positions;

providing a plurality of mounting apertures for positional adjustment of said at least one shelf;

supporting said at least one shelf with a shelf bracket, said shelf bracket having an upper retainer and a lower retainer;

engaging said shelf bracket with a removable bracket lock such that said lower retainer and a lock retainer of said bracket lock extend through a single aperture of said plurality of mounting apertures, and said removable bracket lock inhibits removal of said shelf bracket wherein said bracket lock is fixed relative to said shelf bracket, and wherein said lock retainer extends downward.

* * * * *